US006122776A

United States Patent [19]

Cheng

[11] Patent Number: 6,122,776

[45] Date of Patent: Sep. 26, 2000

[54] BATHING CHAIR

[76] Inventor: Yu Wen Cheng, 2F, No. 137, Yuh-Rern Road, Pei Tou, Taipei, Taiwan

[21] Appl. No.: 09/390,407

[22] Filed: Sep. 3, 1999

[51] Int. Cl.[7] ..... A47K 3/022

[52] U.S. Cl. ..... 4/578.1; 4/571.1; 297/440.24; 297/452.2

[58] Field of Search ..... 4/571.1, 573.1, 4/574.1, 576.1, 578.1, 579; 297/440.24, 452.2; 403/398, 396, 389, 385; 285/124.1, 124.2, 188

[56] References Cited

U.S. PATENT DOCUMENTS 577,220 2/1897 Whitehead ..... 403/385
2,694,438 11/1954 Frech ..... 297/440.24
5,058,949 10/1991 Von Hoffman ..... 297/440.24
5,822,809 10/1998 Gallo ..... 4/578.1

*Primary Examiner*—Steven O. Douglas
*Assistant Examiner*—Tuan Nguyen
*Attorney, Agent, or Firm*—Pro-Techtor International Services

[57] ABSTRACT

A bathing chair, comprising: a seat; a frame, further comprising a front bar and a rear bar, shaped like the letter U turned upside down and mounted on the lower side of the seat, being rotatable around a horizontal axis; a right support bar and a left support bar, mounted between the ends of the front bar and the rear bar and having connecting ends; and a plurality of connecting devices, each having a tube for inserting one of the ends of the right and left support bars, so as to connect the right and left support bars with the front and rear bars.

2 Claims, 4 Drawing Sheets

BATHING CHAIR

BACKGROUND OF THE INVENTION

1. Field of the Invention

The present invention relates to a bathing chair, particularly to improved supporting legs of a bathing chair.

2. Description of Related Art

Conventional bathing chairs have been developed and appeared on the market to assist persons with disabled lower bodies or difficulties to take a shower while standing upright. Bathing chairs allow to take a bath or a shower in a sitting position.

As shown in FIG. 4, a conventional bathing chair for taking a bath in a bathtub has a frame 1, consisting of a front bar 2 and a rear bar 3. The front bar 2 and the rear bar 3 each have a horizontal middle section, which on both ends is continued by legs 4 that are bent towards the ground. Both the front bar 2 and the rear bar 3 straddle an edge of the bathtub. A seat 6 is mounted on the frame 1. A left support bar 7, shaped like the letter U turned upside down, connects the front and rear bars 2, 3 on ends thereof inside the bathtub, further providing a hold for a user to facilitate entering and leaving the bathtub. A right support bar 8, shaped like the letter U turned upside down, connects the front and rear bars 2, 3 on ends thereof outside the bathtub.

A conventional bathing chair is easily stored and transported. The front and rear bars 2, 3 of the frame 1 are rotatable around the middle sections thereof, allowing to be folded in a horizontal plane along the seat B. The left and right support bars 7, 8 are fastened to the front and rear bars 2, 3 by bolts 9 and are easily dismounted. For storing or transporting the bathing chair, the left and right support bars 7, 8 are taken away from the front and rear bars 2, 3 to allow to fold the front and rear bars 2, 3. After purchasing the bathing chair, the left and right support bars 7, 8 have to be fastened to the front and rear bars 2, 3 to get a stable arrangement.

For assembling the left and right support bars 7, 8 and the front and rear bars 2, 3, the user has to align holes for the bolts 9 and to insert the bolts 9. However, since the left and right support bars 7, 8 and the front and rear bars 2, 3 are not fixed, but sway around, the aligning task is cumbersome.

Furthermore, the user will often take the bathing chair with her or him. Then the bathing chair has to be disassembled and assembled again, which, because of the difficult task of mounting the left and right support bars 7, 8 and the front and rear bars 2, 3, is inconvenient.

SUMMARY OF THE INVENTION

It is therefore the object of the present invention to provide a bathing chair with a frame and legs that are mounted fast.

Another object of the present invention is to provide a bathing chair with simplified assembling of frame and legs for greater convenience.

The present invention can be more fully understood by reference to the following description and accompanying drawings.

DETAILED DESCRIPTION OF THE PREFERRED EMBODIMENT

Figure 1:
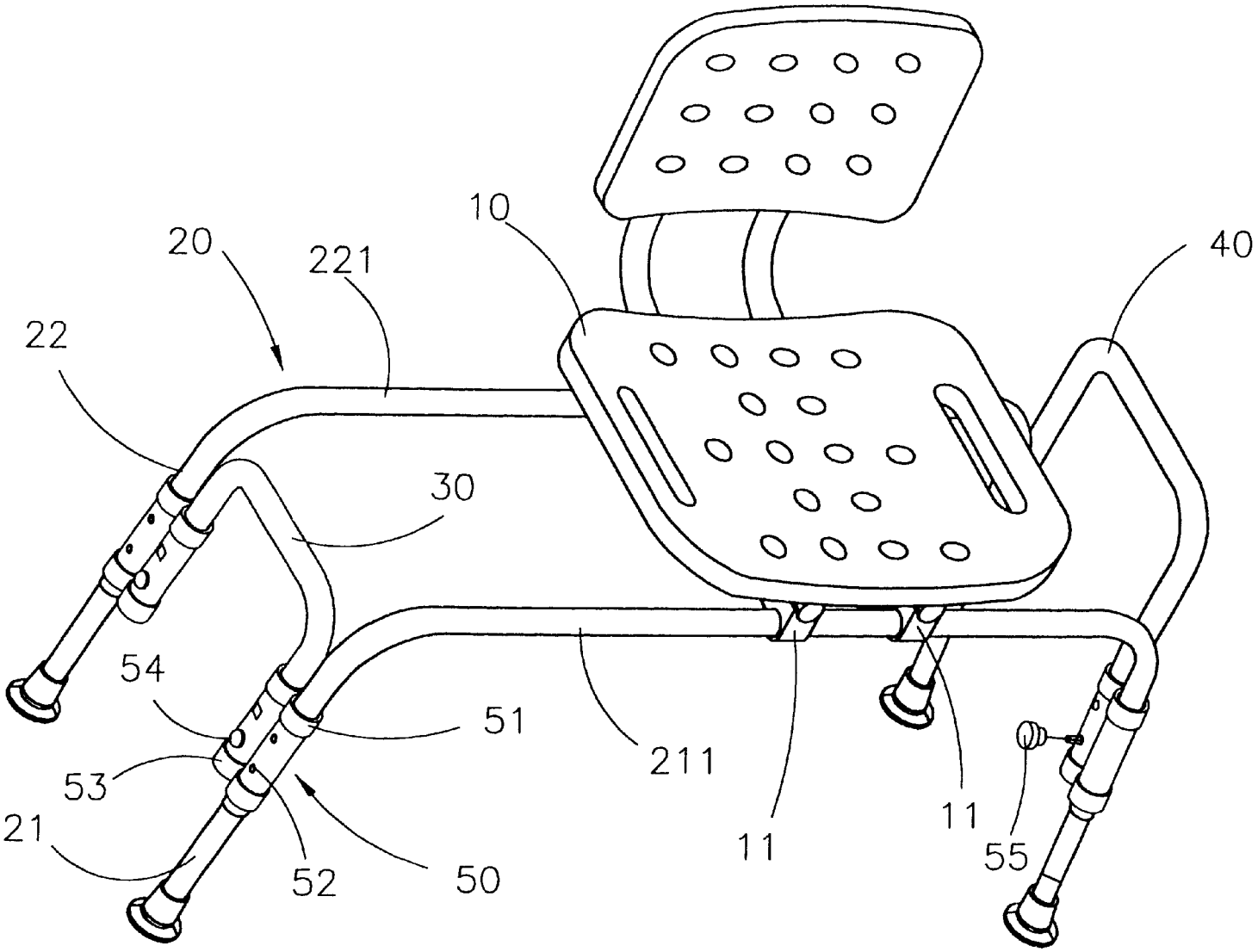
FIG. 1 is a perspective view of the bathing chair of the present invention when assembled.

As shown in FIG. 1, the bathing chair of the present invention mainly comprises: a seat 10 for seating a user during bathing; a frame 20, having a right side, a left side, a front bar 21 and a rear bar 22; a right support bar 30 and a left support bar 40 between the front and rear bars 21, 22; and several connecting devices 50, connecting the front and rear bars 21, 22 with the right and left support bars 30, 40.

The front and rear bars 21, 22 are shaped like the letter U turned upside down, each having a horizontal middle section 211, 221, where the seat 10 is mounted, and each further having right and left ends which are bent down in a vertical direction. The seat 10 has a lower side with several connecting elements 11 to mount the seat 10 on the middle sections 211, 221. The front and rear bars 21, 22 are rotatable around the connecting elements 11, allowing to unfold the front and rear bars 21, 22 in the vertical direction or to fold the front and rear bars 21, 22 in the horizontal plane.

The right support bar 30 is located on the right side of the frame 20, having connecting ends fastened to the front and rear bars 21, 22 on the right ends thereof while the front and rear bars 21, 22 are unfolded. The left support bar 40 is located on the left side of the frame 20, having connecting ends fastened to the front and rear bars 21, 22 on the left ends thereof while the front and rear bars 21, 22 are unfolded. The left support bar 40 extends to a height above the seat 10, providing the user with a hold.

The main characteristic of the present invention is that one of the connecting devices 50 is mounted on each of the right and left ends of the front and rear bars 21, 22. Each of the connecting devices 50 has a first tube 51, surrounding one of the right and left ends of the front and rear bars 21, 22 and fixed thereon by a pin 52 or another fixing element. Each of the connecting devices 50 further has a second tube 53, linked to the first tube 51 and parallel thereto, accommodating one connecting end of one of the right and left support bars 30, 40.

Figure 3:
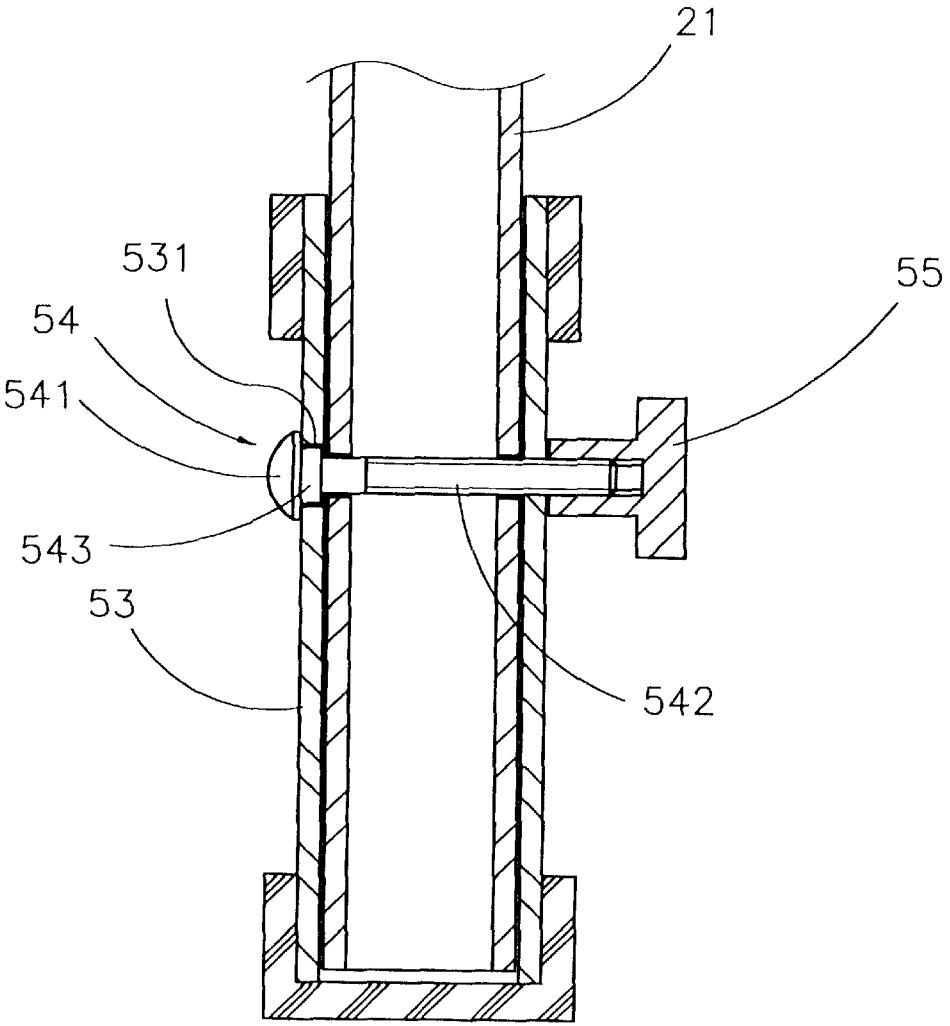
FIG. 3 is a sectional view of the connecting device and the fixing bolt of the present invention.
Figure 4:
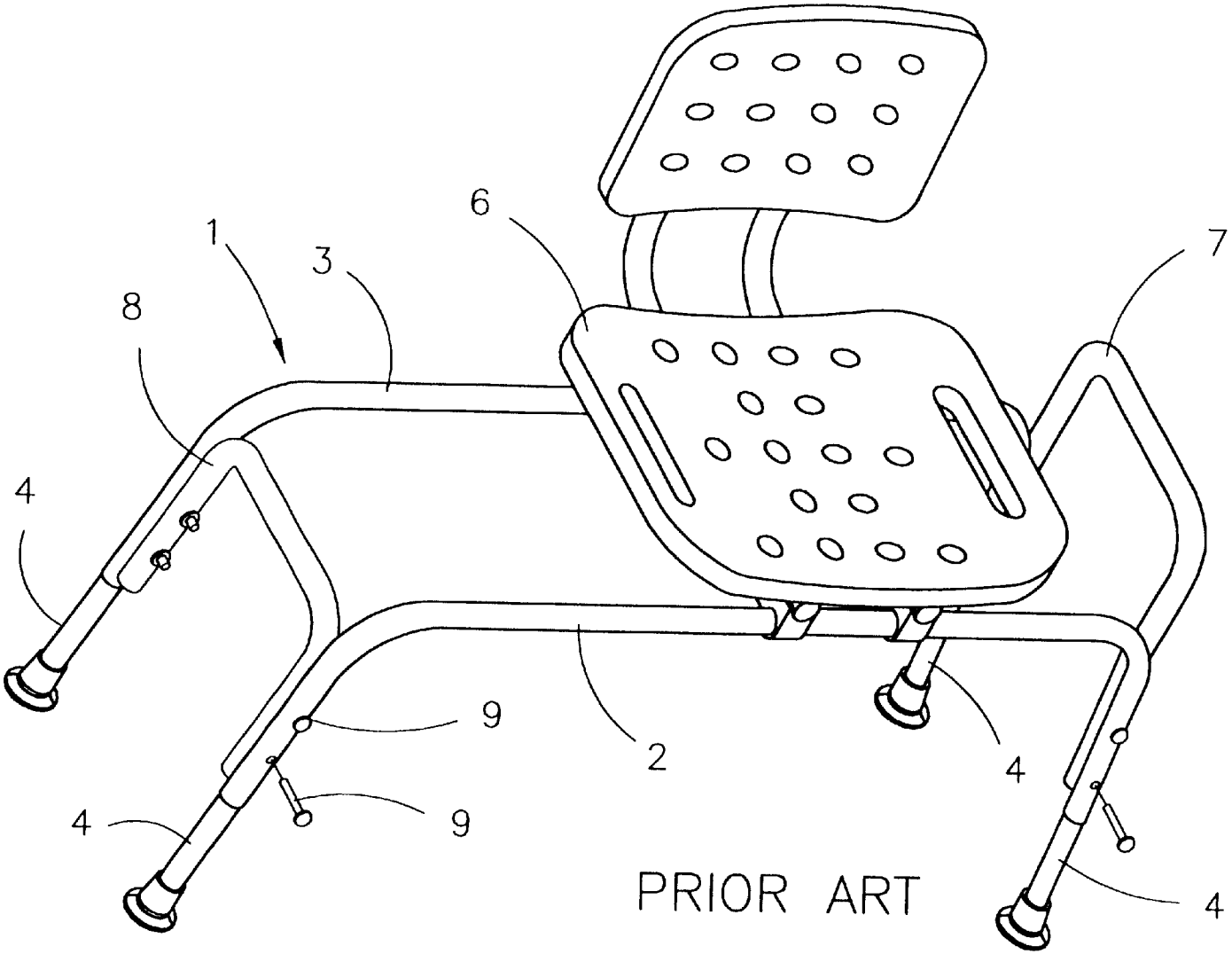
PRIOR ART FIG. 4
FIG. 4 is a perspective view of a conventional bathing chair.

After inserting into the second tube 53, one of the connecting ends of one of the right and left support bars 30, 40 is fixed therein by fixing bolts 54. As shown in FIG. 3, several openings 531 are bored into the second tube 53, and several holes 31, 41 are bored into the ends of the right and left support bars 30, 40 to be aligned with the openings 531. The fixing bolt 54 has a head 541, a thread 542 and a free end. For fixing, the fixing bolt 54 passes through the openings 531 and 31, 41, and a nut 55 with a handle is set on the free end of the fixing bolt 54 and fastened manually.

The head 541 of the fixing bolt 54 has a blocking part 543 with a rectangular cross-section. The opening 531 has a cross-section which is equal to the cross-section of the blocking part 543. Thus the fixing bolt 54, when inserted into the opening 531, is prevented from turning, and the nut 55 is easily fastened on the free end of the fixing bolt 54.

Figure 2:
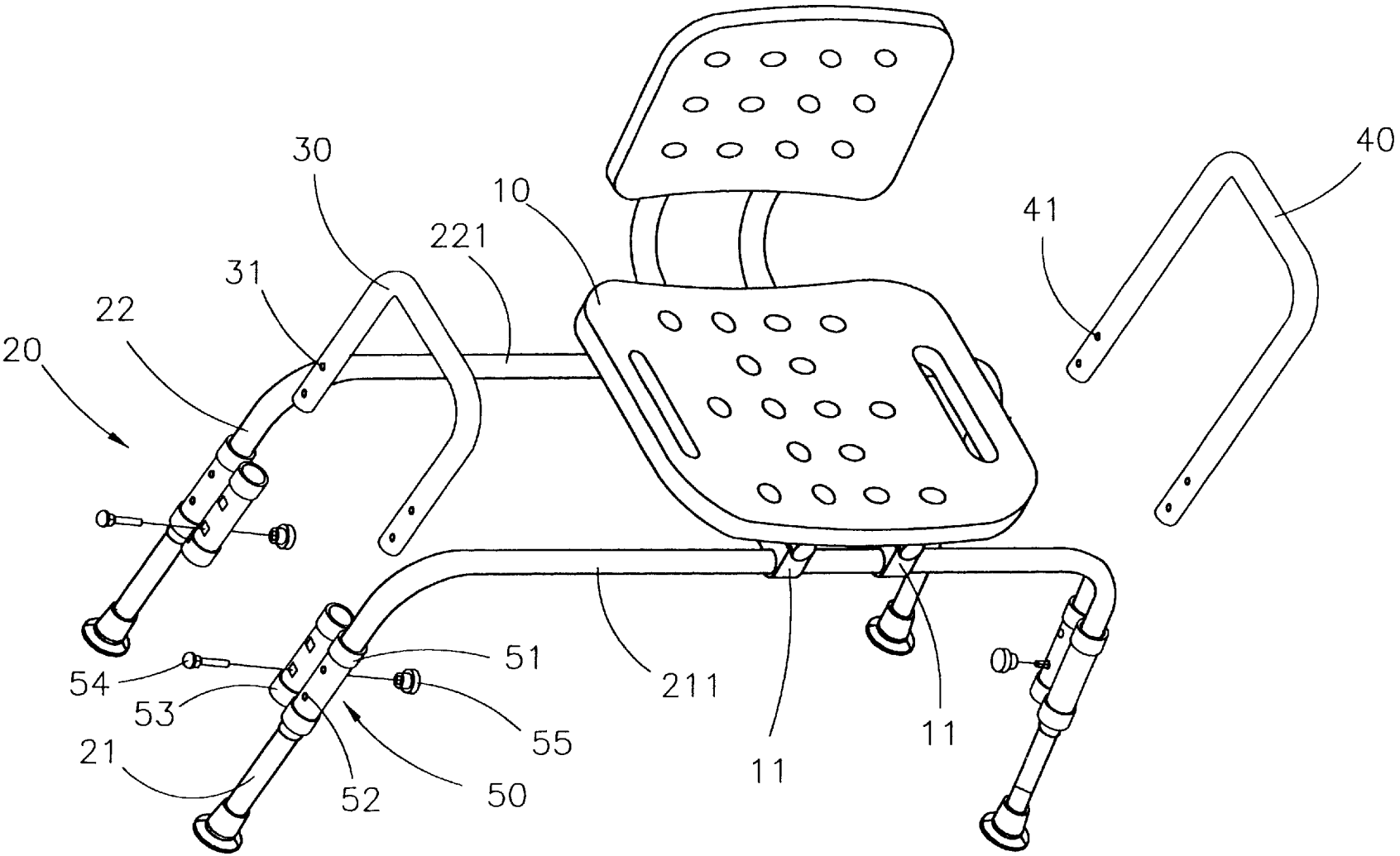
FIG. 2 is a perspective view of the bathing chair of the present invention when disassembled.

Referring to FIG. 2, after purchasing the bathing chair of the present invention, for using the bathing chair first the front and rear bars 21, 22 are unfolded into the vertical direction. Then the ends of the right and left support bars 30, 40 are inserted into the second tubes 53 of the connecting devices 50 to a maximum depth. For each connecting device 50 the fixing bolt 54 is pushed through the opening 531, and the nut 55 is fastened on the fixing bolt 54. Thus the right and left support bars 30, 40 are connected with the front and rear bars 21, 22.

The present invention for assembling only requires to insert the ends of the right and left support bars 30, 40 into the second tubes 53. Then the right and left support bars 30, 40 are positioned, with the openings 531 and 31, 41 a aligned. The fixing bolts 54 are then readily applied. Assembling the bathing chair of the present invention is therefore easy and fast.

While the invention has been described with reference to a preferred embodiment thereof, it is to be understood that modifications or Variations may be easily made without departing from the spirit of this invention which is defined by the appended claims.

What is claimed is:

1. A bathing chair, comprising:

a seat having a lower side;

a frame comprising a front bar and a rear bar, each of said front and rear bars is shaped like an inverted U with a middle section along a horizontal axis and right and left ends that are perpendicular to said middle section, said middle section is mounted on said lower side of said seat, said front and rear bars are rotatable around said horizontal axis;

a right support bar mounted between said right end of said front bar and said right end of said rear bar and having connecting ends;

a left support bar mounted between said left end of said front bar and said left end of said rear bar and having connecting ends; and a plurality of connecting devices, each of said connecting devices having a tube to receive one of said connecting ends so as to connect said right and left support bars with said front and rear bars, each of said tubes of said connecting devices has at least one opening, said connecting ends of said right and left support bars have holes, and for each of said connecting devices said at least one opening of said tube and said holes of a corresponding connecting end are aligned and linked by a bolt.

2. The bathing chair according to claim 1, wherein:

each said bolt of said connecting devices has a free end on which a nut is set and a head with a blocking element having a rectangular cross-section, and said opening of said tube secures said head of each said bolt therein such that after putting said bolt through said opening of said tube, said bolt is prevented from turning when said nut is turned on said free end.

* * * * *